US010337796B2

(12) United States Patent
Wu et al.

(10) Patent No.: US 10,337,796 B2
(45) Date of Patent: Jul. 2, 2019

(54) DOUBLE-SEALING TYPE APPARATUS FOR COLLECTING SPRAY FREEZE ICE BALL PARTICLES AND COLLECTING METHOD THEREOF

(71) Applicant: SOOCHOW UNIVERSITY, Suzhou (CN)

(72) Inventors: Duo Wu, Suzhou (CN); Zhenkai Liao, Suzhou (CN); Shengyu Zhang, Suzhou (CN); Zhangxiong Wu, Suzhou (CN); Jie Xiao, Suzhou (CN); Xiaodong Chen, Suzhou (CN)

(73) Assignee: SOOCHOW UNIVERSITY, Suzhou (CN)

( * ) Notice: Subject to any disclaimer, the term of this patent is extended or adjusted under 35 U.S.C. 154(b) by 114 days.

(21) Appl. No.: 15/565,501

(22) PCT Filed: Aug. 29, 2016

(86) PCT No.: PCT/CN2016/097125
§ 371 (c)(1),
(2) Date: Oct. 10, 2017

(87) PCT Pub. No.: WO2017/166669
PCT Pub. Date: Oct. 5, 2017

(65) Prior Publication Data

US 2018/0073807 A1 Mar. 15, 2018

(30) Foreign Application Priority Data

Apr. 1, 2016 (CN) ..... 2016 1 0202235

(51) Int. Cl.
*F26B 5/06* (2006.01)
*F26B 25/00* (2006.01)

(52) U.S. Cl.
CPC ..... *F26B 25/008* (2013.01); *F26B 5/065* (2013.01)

(58) Field of Classification Search
CPC .. F26B 25/08; F26B 5/065; F25C 1/22; F25C 1/10; F25C 1/00
(Continued)

(56) References Cited

U.S. PATENT DOCUMENTS 8,080 A * 5/1851 Gorrie ..... F25C 1/00 62/66
3,324,565 A * 6/1967 Smith, Jr. ..... F26B 5/06 34/290
(Continued)

FOREIGN PATENT DOCUMENTS

CA 3004789 A1 * 5/2017 ..... A61K 9/19
CN 101449119 A 6/2009
(Continued)

*Primary Examiner* — Stephen M Gravini
(74) *Attorney, Agent, or Firm* — SZDC Law P.C.

(57) ABSTRACT

A double-sealing type apparatus for collecting spray freeze ice ball particles and a collecting method for the double-sealing type apparatus are provided. The double-sealing type apparatus includes a collector, a collecting trolley, a vacuum pumping device, a heating device, a first sealing pad and a second sealing pad. The collector is arranged on the collecting trolley, and is provided with a collecting port. The collecting port corresponds to a discharging port at the bottom of a freezing tower. A water inlet is further provided at the collecting port, and the water inlet is in communication with a space formed by the aligning of the collecting port and the discharging port. Good sealing performance is achieved in a double-sealing manner including the sealing pads and the ice sealing, so as to smoothly transfer ice balls in the freezing tower.

16 Claims, 2 Drawing Sheets

(58) Field of Classification Search
USPC ..... 34/290
See application file for complete search history.

(56) References Cited

U.S. PATENT DOCUMENTS

| | | | | |
|---|---|---|---|---|
| 5,327,660 | A * | 7/1994 | Emory | F26B 5/041 34/112 |
| 7,343,696 | B2 * | 3/2008 | Covert | F26B 5/06 34/92 |
| 8,689,460 | B2 * | 4/2014 | Kuu | F26B 5/06 34/287 |
| 8,793,896 | B2 * | 8/2014 | Patel | G01N 21/68 165/185 |
| 9,347,707 | B2 * | 5/2016 | Struschka | F26B 5/06 |
| 9,528,737 | B2 * | 12/2016 | Jafa | F25C 5/04 |
| 9,945,611 | B2 * | 4/2018 | DeMarco | F26B 5/065 |
| 10,006,706 | B2 * | 6/2018 | Luy | F26B 5/06 |
| 2008/0142166 | A1 * | 6/2008 | Carson | B01D 1/18 159/4.01 |
| 2009/0173090 | A1 | 7/2009 | Yamaguchi et al. | |
| 2015/0059395 | A1 | 3/2015 | Kim | |
| 2018/0073807 | A1 * | 3/2018 | Wu | F26B 25/008 |
| 2018/0120027 | A1 * | 5/2018 | Ganguly | A23L 3/44 |
| 2018/0327478 | A1 * | 11/2018 | Olbrich | A61K 9/19 |

FOREIGN PATENT DOCUMENTS

| | | | | |
|---|---|---|---|---|
| CN | 104422219 | A | 3/2015 | |
| CN | 105318666 | A | 2/2016 | |
| CN | 105674691 | A | 6/2016 | |
| CN | 205607032 | U | 9/2016 | |
| JP | H02118375 | A | 5/1990 | |
| WO | WO-2017080915 | A1 * | 5/2017 | A61K 9/19 |
| WO | WO-2017166669 | A1 * | 10/2017 | F26B 5/065 |

* cited by examiner

DOUBLE-SEALING TYPE APPARATUS FOR COLLECTING SPRAY FREEZE ICE BALL PARTICLES AND COLLECTING METHOD THEREOF

The present application is a National Phase entry of PCT Application No. PCT/CN2016/097125, filed Aug. 29, 2016, which claims the priority to Chinese Patent Application No. 201610202235.8, titled "DOUBLE-SEALING TYPE APPARATUS FOR COLLECTING SPRAY FREEZE ICE BALL PARTICLES AND COLLECTING METHOD THEREEOF," filed on Apr. 1, 2016 with the Chinese State Intellectual Property Office, the entire disclosures of which are incorporated herein by reference.

TECHNICAL FIELD

The present application relates to the technical field of spray freeze drying, and in particular to a double-sealing type apparatus for collecting spray freeze ice ball particles and a collecting method of the double-sealing type apparatus.

BACKGROUND

The spray freeze drying technology mainly includes two processes, that is, freezing droplets into ice balls and the ice balls drying. Specifically, the two processes may be performed in one apparatus or may be performed in two apparatus separately. Currently, with a laboratory-level small spray freeze drying device, the two processes of freezing and drying can be realized in one device. However, the above method is merely applicable to a small intermittent operation, and not applicable to continuous operation or a large and medium-sized device.

To achieve continuous operations, it is required to transfer the collected ice balls into a vacuum freeze drying device, and a process of transferring the collected ice balls typically has the following three problems.

1. Moisture in the air enters into a freezing chamber, causing freezing on an inner wall of the freezing chamber;
2. The moisture in the air accumulates on a surface of the ice ball, causing the ice balls to be bonded; and
3. The ice balls melt.

Hence, it is necessary to provide a further solution for the above problems.

SUMMARY

In view of the above, a double-sealing type apparatus for collecting spray freeze ice ball particles and a collecting method of the double-sealing type apparatus are provided according to the present application, which overcomes the defects in the conventional technology.

To achieve the above object, a technical solution of the double-sealing type apparatus according to an embodiment of the present application is described as follows.

A double-sealing type apparatus for collecting spray freeze ice ball particles includes a collector, a collecting trolley, a vacuum pumping device, a heating device, a first sealing pad and a second sealing pad;

where the collector is arranged on the collecting trolley and is provided with a collecting port, and the collecting port is corresponding to a discharging port at the bottom of a freezing tower and is configured to be aligned with the discharging port, the discharging port and the collecting port are opened or closed by a first baffle and a second baffle, respectively;

a water inlet is further arranged at the collecting port, and the water inlet is in communication with a space which is formed by the aligning of the collecting port and the discharging port, and ice sealing is formed between the collecting port and the discharging port in the case that water is injected into the water inlet; and the vacuum pumping device is in communication with an internal space of the collector, the heating device and the first sealing pad are arranged at the collecting port, sealing between the collecting port and the discharging port is formed by the first sealing pad in the case that the collecting port is aligned with the discharging port, and the second sealing pad is arranged at the bottom of the collector.

As an improvement of the double-sealing type apparatus for collecting spray freeze ice ball particles according to the present application, the collector is in the shape of a cone.

As an improvement of the double-sealing type apparatus for collecting spray freeze ice ball particles according to the present application, the bottom of the collecting trolley is provided with a brake wheel.

As an improvement of the double-sealing type apparatus for collecting spray freeze ice ball particles according to the present application, the collector and the collecting trolley are connected in a detachable manner.

As an improvement of the double-sealing type apparatus for collecting spray freeze ice ball particles according to the present application, one end of each of the first baffle and the second baffle is provided with a handle, and the other end of each of the first baffle and the second baffle has a sloping structure.

As an improvement of the double-sealing type apparatus for collecting spray freeze ice ball particles according to the present application, the vacuum pumping device includes a vacuum pump and a vacuum meter, the vacuum pump is in communication with the internal space of the collector, and the vacuum meter may be configured to display a vacuum degree of the internal space of the collector.

As an improvement of the double-sealing type apparatus for collecting spray freeze ice ball particles according to the present application, the heating device includes a heating ring.

As an improvement of the double-sealing type apparatus for collecting spray freeze ice ball particles according to the present application, the double-sealing type apparatus further includes a thermometer extending into the internal space of the collector.

To achieve the above objects, a technical solution of a collecting method according to an embodiment of the present application is described as follows. The collecting method for the double-sealing type apparatus for collecting spray freeze ice ball particles as described above includes:

step S1, pushing the double-sealing type apparatus to a position below the freezing tower for aligning the collecting port with the discharging port, and keeping the collecting trolley in a secured position;

step S2, injecting water into the water inlet for forming ice sealing between the collecting port and the discharging port;

step S3, taking away the first baffle at the discharging port to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, and turning on the heating device, and after ice for forming the ice sealing melts, pushing the double-sealing type apparatus away by the collecting trolley; and step S6, performing steps S1 to S5 repeatedly until collecting and transferring for ice balls are completed.

Compared with the conventional technology, the present application has following advantages. The double-sealing type apparatus for collecting spray freeze ice ball particles according to the present application can overcome the defects in the conventional technology, and smoothly transfer the ice balls in the freezing tower. Good sealing performance is achieved in a double-sealing manner including the sealing pads and the ice sealing. Moreover, the used collecting trolley may be changed if desired, which is for convenience to use.

BRIEF DESCRIPTION OF THE DRAWINGS

In order to illustrate technical solutions in the embodiments of the present application or in the conventional technology more clearly, drawings used in the description of the embodiments or the conventional technology are introduced briefly hereinafter. The drawings described hereinafter merely illustrate some embodiments of the present application, and other drawings may be obtained by those skilled in the art based on these drawings without any creative efforts.

DETAILED DESCRIPTION OF THE EMBODIMENTS

To make those skilled in the art better understand the technical solutions of the present application, the technical solutions according to the embodiments of the present application are described clearly and completely in conjunction with the drawings in the embodiments of the present application hereinafter. Apparently, the described embodiments are only a few rather than all of the embodiments of the present application. All the other embodiments obtained by those skilled in the art without any creative work based on the embodiments of the present application fall within the protection scope of the present application.

Figure 1:
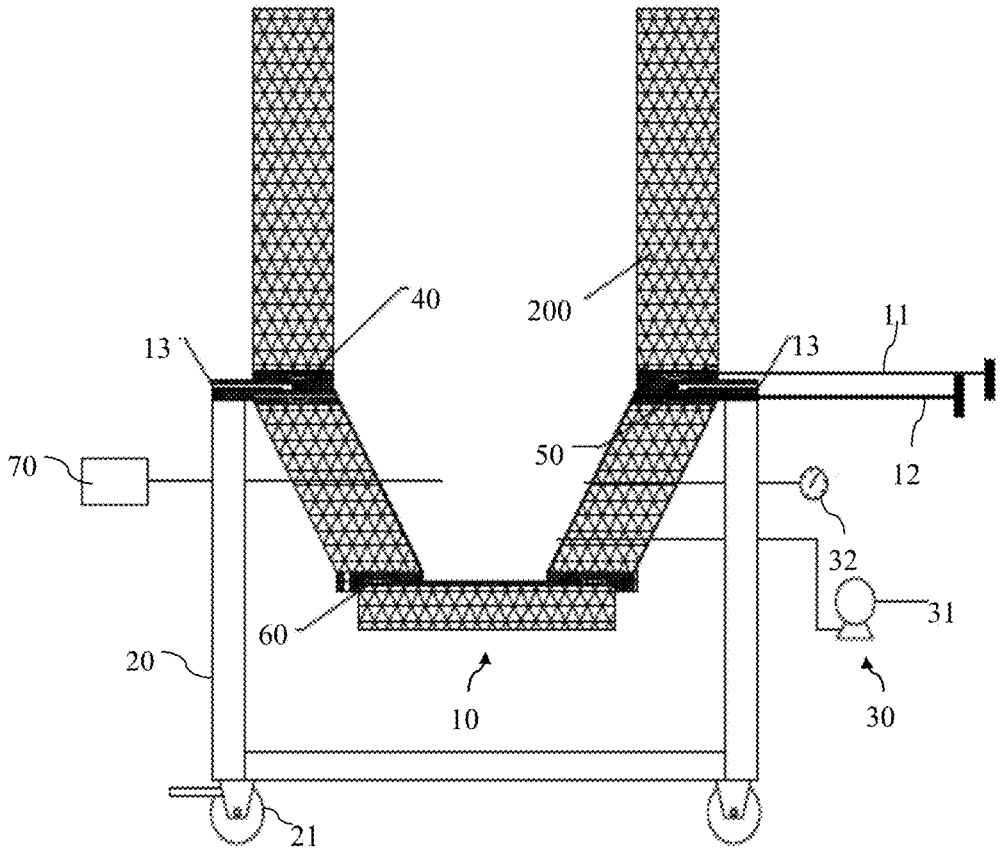
FIG. 1 is a schematic diagram of a planar structure of a double-sealing type apparatus for collecting spray freeze ice ball particles according to an embodiment of the present application.
Figure 2:
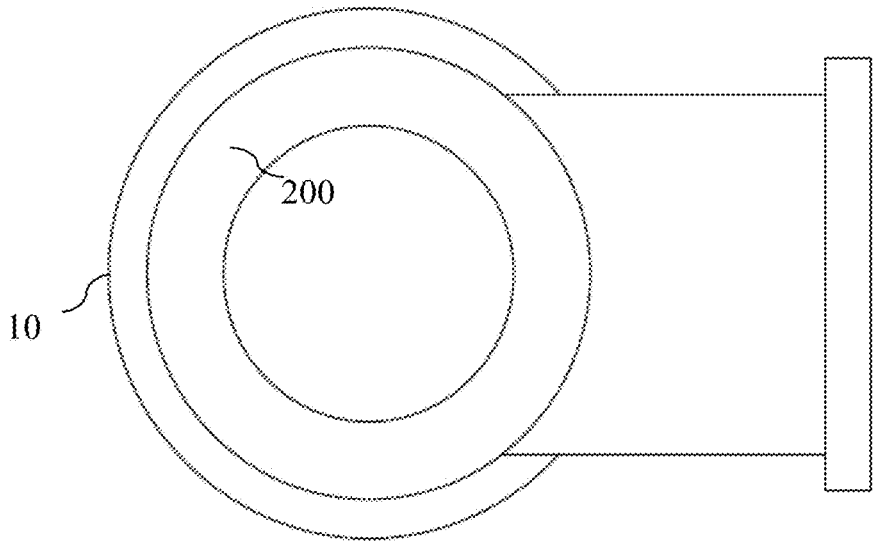
FIG. 2 is a top view of the double-sealing type apparatus in FIG. 1.

FIG. 1 is a schematic diagram of a planar structure of a double-sealing type apparatus for collecting spray freeze ice ball particles according to an embodiment of the present application, and FIG. 2 is a top view of the double-sealing type apparatus in FIG. 1.

As shown in conjunction with FIGS. 1 and 2, the double-sealing type apparatus for collecting spray freeze ice ball particles according to the present application may be configured to cooperate with a freezing tower, so as to collect ice balls in the freezing tower. Specifically, the double-sealing type apparatus includes a collector 10, a collecting trolley 20, a vacuum pumping device 30, a heating device 40, a first sealing pad 50 and a second sealing pad 60.

The collector 10 is arranged on the collecting trolley 20 and is provided with a collecting port, through which ice balls in the freezing tower 200 may enter into an interior of the collector 10. Preferably, the collector 10 may be in the shape of a cone. In addition, in order to facilitate replacement of the collecting trolley, the collector 10 and the collecting trolley 20 are connected in a detachable manner.

Further, in order to smoothly collect the ice balls, the collecting port corresponds to a discharging port at the bottom of the freezing tower, and may be aligned with the discharging port. The meaning of corresponding is that a diameter of the collecting port corresponds to a diameter of the discharging port. In addition, it is further required that the height of the double-sealing type apparatus according to the present application is same with the height of the discharging port at the bottom of the freezing tower from the ground. The bottom of the collecting trolley 20 is provided with a brake wheel 21, thus the double-sealing type apparatus is kept in a secured position by the brake wheel 21 in the case that the collecting port is aligned with the discharging port, thereby avoiding the misaligning of the collecting port and the discharging port.

Figure 3:
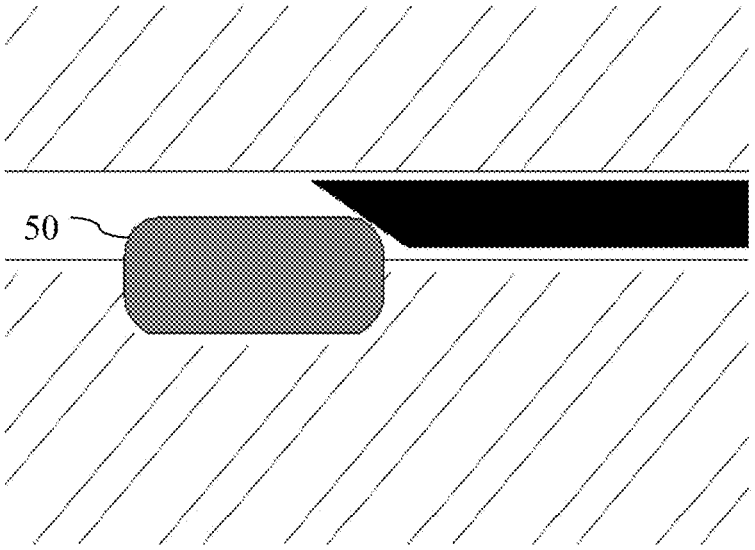
FIG. 3 is a schematic plan diagram showing that a baffle is inserted into a slot.

With reference to FIG. 3, the discharging port and the collecting port are opened or closed by the first baffle 11 and the second baffle 12, respectively. One end of each of the first baffle 11 and the second baffle 12 is provided with a handle, and the other end of each of the first baffle 11 and the second baffle 12 has a sloping structure. Thus, in the case that the baffle is inserted into a slot so as to close the port corresponding to the baffle, it is noted that the sloping structure is arranged downwards, in this way, it is convenient to ensure the sealing performance of the port.

The first sealing pad 50 is arranged at the collecting port. Sealing between the collecting port and the discharging port can be further formed by the first sealing pad 50 in a case that the collecting port is aligned with the discharging port, so as to prevent heat transfer. Moreover, the second sealing pad 60 is arranged at the bottom of the collector 10. In this way, the first sealing pad 50 and the second sealing pad 60 together form a first sealing of the double-sealing type apparatus according to the present application.

Moreover, a water inlet 13 is further arranged at the collecting port. The water inlet 13 is in communication with a space which is formed by the aligning of the collecting port and the discharging port. Thus, in the case that the collecting port is aligned with the discharging port, water is injected into the water inlet, and since a temperature of the freezing tower is low, and ice sealing may be formed between the collecting port and the discharging port. The ice sealing forms a second sealing of the double-sealing type apparatus according to the present application.

Accordingly, the overall sealing performance of the apparatus is effectively ensured by the above two sealing manners, thereby avoiding moisture in the air entering into the freezing chamber and further freezing on the inner wall of the freezing chamber, and avoiding the moisture in the air accumulating on surfaces of the ice balls and further avoiding ice balls bonding and melting, thereby smoothly transferring the ice balls into the freezing tower.

The heating device 40 is arranged at the collecting port. Thus, in the case that the heating device 40 is turned on, the heating device 40 may transfer heat to the ice sealing to make the ice melt and eliminate the ice sealing, and the double-sealing type apparatus in which the ice balls are collected can be pushed away. Preferably, the heating device 40 includes a heating ring.

The vacuum pumping device 30 is in communication with an internal space of the collector 10, and in the case that the vacuum pumping device 30 is turned on, the internal space of the collector 10 is pumped into a vacuum, so as to further prevent heat of the outside from being transferred to the internal space of the collector 10. Preferably, the vacuum pumping device 30 includes a vacuum pump 31 and a vacuum meter 32. The vacuum pump 31 is in communication with the internal space of the collector 10, and the vacuum meter 32 can display a vacuum degree of the internal space of the collector 10.

Further, the double-sealing type apparatus further includes a thermometer 70 extending into the internal space of the collector 10, so as to measure a temperature of the internal space of the collector 10.

Based on the double-sealing type apparatus for collecting spray freeze ice ball particles as described above, a collecting method is further provided according to the present application, which includes steps S1 to S6.

In step S1, a double-sealing type apparatus is pushed to a position below the freezing tower for aligning the collecting port with the discharging port, and the collecting trolley 20 is kept in a secured position.

In step S2, water is injected into the water inlet 13 for forming ice sealing between the collecting port and the discharging port.

In step S3, the first baffle 11 at the discharging port is taken away, so as to enable the ice balls in the freezing tower to enter into the collector 10.

In step S4, after collecting is completed, the second baffle 12 is inserted to close the collecting port, and the vacuum pumping device 30 is turned on to pump the internal space of the collector 10 into a vacuum.

In step S5, the first baffle 11 is inserted, the heating device 40 is turned on, and after ice for forming the ice sealing melts, the double-sealing type apparatus is pushed away by the collecting trolley 20.

In step S6, steps S1 to S5 are performed repeatedly until collecting and transferring for the ice balls are completed.

In summary, the double-sealing type apparatus for collecting spray freeze ice ball particles according to the present application can overcome the defects in the conventional technology and smoothly transfer the ice balls in the freezing tower. Good sealing performance is achieved in a double-sealing manner including the sealing pads and the ice sealing. Moreover, the collecting trolley may be replaced if desired, which is convenience to use.

It is apparent to those skilled in the art that the present application is not limited to the details of the above-described exemplary embodiments, and the present application can be implemented in other specific forms without departing from the spirit or essential characteristics thereof. Accordingly, in every respect, the embodiments should be considered as the exemplary embodiments rather than restrictive embodiments, and the scope of the present application is defined by the appended claims rather than the foregoing description, therefore, the present application is intended to cover all changes falling within the meaning and scope of the equivalent elements of the claims. Any reference signs in the claims should not to be regarded as limiting the related claims.

In addition, it should be understood that, although this specification is described according to the embodiments, each embodiment does not include only one independent technical solution, and the description of the specification is merely for the sake of clarity. Those skilled in the art should take the specification as a whole, and the technical solutions in the embodiments may also be suitably combined to form other embodiments which may be understood by those skilled in the art.

The invention claimed is:

1. A double-sealing type apparatus for collecting spray freeze ice ball particles, comprising:

a collector, a collecting trolley, a vacuum pumping device, a heating device, a first sealing pad, and a second sealing pad, wherein the collector is arranged on the collecting trolley and is provided with a collecting port, the collecting port corresponding to a discharging port at the bottom of a freezing tower and is configured to be aligned with the discharging port, and the discharging port and the collecting port are opened or closed by a first baffle and a second baffle, respectively;

a water inlet is further arranged at the collecting port, and the water inlet is in communication with a space which is formed by the aligning of the collecting port and the discharging port, and ice sealing is formed between the collecting port and the discharging port in case that water is injected into the water inlet; and the vacuum pumping device is in communication with an internal space of the collector, the heating device and the first sealing pad are arranged at the collecting port, sealing between the collecting port and the discharging port is formed by the first sealing pad in case that the collecting port is aligned with the discharging port, and the second sealing pad is arranged at the bottom of the collector.

2. The double-sealing type apparatus for collecting spray freeze ice ball particles according to claim 1, wherein the collector is in the shape of a cone.

3. The double-sealing type apparatus for collecting spray freeze ice ball particles according to claim 1, wherein a brake wheel is provided at the bottom of the collecting trolley.

4. The double-sealing type apparatus for collecting spray freeze ice ball particles according to claim 1, wherein the collector and the collecting trolley are connected in a detachable manner.

5. The double-sealing type apparatus for collecting spray freeze ice ball particles according to claim 1, wherein one end of each of the first baffle and the second baffle is provided with a handle, and the other end of each of the first baffle and the second baffle has a sloping structure.

6. The double-sealing type apparatus for collecting spray freeze ice ball particles according to claim 1, wherein the vacuum pumping device comprises a vacuum pump and a vacuum meter, the vacuum pump is in communication with the internal space of the collector, and the vacuum meter is configured to display a vacuum degree of the internal space of the collector.

7. The double-sealing type apparatus for collecting spray freeze ice ball particles according to claim 1, wherein the heating device comprises a heating ring.

8. The double-sealing type apparatus for collecting spray freeze ice ball particles according to claim 1, further comprising a thermometer extending into the internal space of the collector.

9. A collecting method for the double-sealing type apparatus for collecting spray freeze ice ball particles according to claim 1, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

10. A collecting method for the double-sealing type apparatus for collecting spray freeze ice ball particles according to claim 2, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

11. A collecting method for the double-sealing type apparatus for collecting spray freeze ice ball particles according to claim 3, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

12. A collecting method for the double-sealing type apparatus for collecting spray freeze ice ball particles according to claim 4, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

13. A collecting method for the double-sealing type apparatus for collecting spray freeze ice ball particles according to claim 5, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

14. A collecting method for the double-sealing type apparatus for collecting spray freeze ice ball particles according to claim 6, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

15. A collecting method for the double-sealing type apparatus for collecting spray freeze ice ball particles according to claim 7, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

16. A collecting method for the double-sealing type apparatus for collecting spray freeze ice ball particles according to claim 8, comprising:

step S1, pushing the double-sealing type apparatus to a position below the freezing tower, for aligning the collecting port with the discharging port, and keeping the collecting trolley in a secured position;

step S2, injecting water into the water inlet for forming ice sealing between the collecting port and the discharging port;

step S3, taking away the first baffle at the discharging port, to allow ice balls in the freezing tower to enter into the collector;

step S4, after collecting is completed, inserting the second baffle to close the collecting port, and turning on the vacuum pumping device to pump the internal space of the collector into a vacuum;

step S5, inserting the first baffle, turning on the heating device, and after ice forming the ice sealing melts, pushing the double-sealing type apparatus away by the collecting trolley; and step S6, performing steps S1 to S5 repeatedly until collecting and transferring for ice balls are completed.

* * * * *